US006472021B2

(12) United States Patent
Bower

(10) Patent No.: US 6,472,021 B2
(45) Date of Patent: Oct. 29, 2002

(54) METHOD FOR AVOIDING RE-CIRCULATION DEFECTS IN CURTAIN COATING

(75) Inventor: Christopher L. Bower, Headington (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/773,640

(22) Filed: Jan. 31, 2001

(65) Prior Publication Data

US 2001/0016231 A1 Aug. 23, 2001

(30) Foreign Application Priority Data

Feb. 4, 2000 (GB) ..... 0002479

(51) Int. Cl.[7] ..... B05D 1/30
(52) U.S. Cl. ..... 427/420; 118/DIG. 4
(58) Field of Search ..... 427/420; 118/DIG. 4

(56) References Cited

U.S. PATENT DOCUMENTS

| | | | | |
|---|---|---|---|---|
| 3,508,947 A | | 4/1970 | Hughes | |
| 3,632,374 A | | 1/1972 | Greiller | |
| 5,393,571 A | | 2/1995 | Suga et al. | |
| 5,871,821 A | | 2/1999 | Kondo et al. | |
| 5,906,865 A | | 5/1999 | Ellermeier et al. | |
| 6,099,913 A | * | 8/2000 | Clarke et al. | 427/420 |
| 6,103,313 A | * | 8/2000 | Clarke et al. | 427/420 |

FOREIGN PATENT DOCUMENTS

| | | |
|---|---|---|
| EP | 0 426 122 | 5/1991 |
| EP | 0 426 155 | 5/1991 |
| EP | 0 836 117 | 4/1998 |
| JP | 01131549 | 5/1989 |
| WO | 89/05477 | 6/1989 |

OTHER PUBLICATIONS

Slide Coating; Jules Hens and Willy Van Abbenyen, from "Liquid Film Coating", 1997.

Hydrodynamic Assist of Dynamic Wetting; Terence D. Blake and Andrew Clarke and Kenneth J. Ruschak; Feb. 1994; vol. 40, No. 2.

* cited by examiner

*Primary Examiner*—Katherine A. Bareford
(74) *Attorney, Agent, or Firm*—Frank Pincelli

(57) ABSTRACT

A method of curtain coating, the curtain being formed from at least one layer of coating solution having a composite density ρ ($kgm^{-3}$) and a total volumetric flow rate per unit curtain width Q ($m^2s^{-1}$), the curtain being allowed to free fall a distance h (m), at a velocity U ($ms^{-1}$), onto a continuously moving substrate having a velocity S ($ms^{-1}$) with an application angle of θ between the horizontal and tangent to the substrate at the point of impingement, the dynamic surface tension at the rear of the falling curtain being σ ($mNm^{-1}$), the aforementioned variable parameters being controlled so as to prevent recirculation.

5 Claims, 11 Drawing Sheets

METHOD FOR AVOIDING RE-CIRCULATION DEFECTS IN CURTAIN COATING

FIELD OF THE INVENTION

This invention relates to the field of coating by which a plurality of viscous coating compositions may be curtain coated as a composite layer at high speed onto a continuously moving receiving surface, such as in the manufacture of photographic films and papers, magnetic recording tapes and such like.

BACKGROUND OF THE INVENTION

Curtain coating methods for the simultaneous coating of multiple layers are well known. Such methods are described in U.S. Pat. No. 3,508,947 and U.S. Pat. No. 3,632,374. These documents emphasize the advantages of such methods for applying photographic compositions onto paper and polymeric substrates. The coating comprises multiple layers which are formed into a free falling curtain and allowed to impinge upon a continuously moving substrate. Important parameters to consider include the height h of the curtain, the application angle θ between the horizontal and the tangent to the substrate at the point of impingement, measured on the upstream side of the curtain. WO 89/05477 describes how an electrostatic voltage may be applied at the coating point to avoid the problems of air entrainment.

The occurrence of a recirculating flow in curtain coating, sometimes called puddling, is well documented in the prior art. The phenomena of puddling occurs when the volumetric flow rate of the coating liquid is sufficiently high, and/or the substrate speed is sufficiently low, such that a bank of liquid forms at the upstream side of the falling curtain. The excess liquid is sometimes termed a heel. At extremes of high flow rate, and/or low substrate speed, recirculating eddies may be formed within the heel. These persistent recirculating eddies can trap air bubbles or particles and may disrupt the coating flow by prolonging the residence time of a particular coating layer within the heel. They may also lead directly to non-uniform laydown. When an eddy is present, the flow of liquid through the heel may develop a transverse velocity component along the length of the heel which may result in thickness variations of the final coating and/or interlayer mixing. Simultaneous multilayer coatings are a particular problem since the total flow rate is the sum of the individual flow rates for each layer and can rapidly become large as the number of layers increases. The ability to determine the limits within which coating parameters must be kept to avoid recirculation is therefore a considerable aid in reducing coating defects.

Heel formation without the presence of recirculating eddies is possible. It is therefore possible to obtain uniform coatings when a heel is present. Under these conditions flow lines within the heel remain smooth and continuous causing no disruption of the layers. Generally however this is also undesirable since the loss of momentum from the curtain may produce air entrainment at relatively low speeds. This is described in "Hydrodynamics of dynamic wetting" Blake et al. A.I.Ch.E. Journal, 40, (1994), pp229.

A theoretical model describing when eddies occur in bead coating as a function of coating parameters such as Newtonian viscosity and surface tension can be found in Hens J., & Van Abbenyen W., "Slide Coating", in 'Liquid film coating' 1997 ISBN 0412064812. However there is no disclosure of any relation in curtain coating that accounts for the interactive effects of the relevant control parameters such as curtain height, application angle, electrostatic voltage and solution rheology (viscosity). It is known that for Newtonian solutions, increasing curtain height, increasing flow rate and reducing viscosity separately or in combination, promotes puddling. However the effects of shear thinning solution, application angle and electrostatic voltage are not known.

The widespread use of highly shear thinning coating solutions based on gelatin plus a polymeric thickener significantly complicates the issue since the viscosity of such a solution is a strong function of the applied shear rate. Predictions based on Newtonian solutions with constant viscosity give unreliable results when applied to highly shear-thinning (non-Newtonian) solutions of gelatin plus thickener. In order to determine the recirculation behavior of such solutions the effective shear rate within the heel region must be obtained, a value that cannot be measured directly. To determine whether or not a solution is 'highly shear-thinning' the following formula is used:

$$\eta = \frac{\eta_0 - \eta_\infty}{\left(1 + \left(\frac{\gamma}{\gamma_c}\right)^2\right)^{\frac{1-n}{2}}} + \eta_\infty \tag{1}$$

η (cP) is the apparent viscosity of the solution when the applied shear rate is $\gamma$ ($s^{-1}$). The critical shear rate is $\gamma_c$ ($s^{-1}$), above which the solution viscosity begins to decrease from its low shear value $\eta_0$ (cP) ($\gamma<\gamma_c$), down to its limiting high shear value $\eta_\infty$ (cP) ($\gamma>>\gamma_c$). The rate that the viscosity decreases once the shear rate is greater than the critical shear rate, is determined by the power law index n. By fitting equation (1) to viscosity measurements taken over a range of shear rates values for $\gamma_c$ and n can be obtained.. For a Newtonian liquid, n equals 1, and for a shear thinning liquid n is less than 1; the smaller n, the more rapidly viscosity falls with increasing shear rate. In the following description a solution will be termed highly shear thinning if it has a power law index n less than 0.8 and a critical shear rate $\gamma_c$ less than $400s^{-1}$.

The phenomena of air entrainment with recirculation, often referred to as 'sagging', is a restriction on the maximum attainable coating speed in any curtain coating operation. Various practical methods for avoiding sagging are known. EP 426,122(B 1) describes a range of preferred values for the angle of inclination of a hopper slide to the horizontal, and the angle between the falling curtain and a tangent to the substrate at the point of impingement, measured at the downstream side of the curtain. The solution viscosity is then selected to ensure a concave wetting line. The method specifically described in EP 426,122(B1) results in the formation of a heel with a degree of concavity of at least 3 mm, this being the distance measured from a straight line drawn between the edges of the curtain to the centre of the wetting line. No mention is made of the presence or absence of recirculation within the heel. For selection of an appropriate solution viscosity at flow rates <4.0 $cm^2/s$, reference is made to JP 1131549, which also describes a preferred range for the hopper slide angle and a minimum viscosity of 40 cP for the bottom layer of a two layer coating to avoid 'turbulence' in the coating. The term turbulence in the context of JP 1131549 is taken to be the phenomena termed recirculation in this specification. Neither EP 426,122(B 1) nor JP 1131549 disclose the interaction of viscosity, flow rate, substrate speed, application angle or curtain height and the propensity for heel formation. The effects of using shear-thinning coating solutions are similarly unspecified, with the relevant solution viscosity assumed to be that measured at low shear rates of 10–30$s^{-1}$. EP 836,117(A2) mentions specifically the lack of unified understanding of heel formation in curtain coating and the interaction of key coating parameters. U.S. Pat. No. 5,393,571 specifies a preferred range of hopper slide angle and a minimum value of 90 cP for the viscosity at 10$s^{-1}$ of the coating liquid, in conjunction with a minimum substrate roughness of 0.3 $\mu$m. Exactly which roughness parameter is to exceed 0.3 $\mu$m is not specified making the definition of little practical benefit.

The aim of the present invention is to provide a method which avoids the presence of a recirculating heel that may cause coating non-uniformities or reduce the maximum attainable coating speed.

SUMMARY OF THE INVENTION

According to the present invention there is provided a method of curtain coating which avoids coating defects due to recirculation, the curtain being formed from at least one layer of coating solution having a composite density $\rho$ ($kgm^{-3}$) and a total volumetric flow rate per unit curtain width Q ($m^2s^{-1}$), the curtain being allowed to free fall a distance h (m), at a velocity U ($ms^{-1}$), onto a continuously moving substrate having a velocity S ($ms^{-1}$) with an application angle of $\theta$ between the horizontal and tangent to the substrate at the point of impingement, the dynamic surface tension at the rear of the falling curtain being $\sigma$ ($mNm^{-1}$), the aforementioned variable parameters being controlled so as to satisfy the following inequality;

$$We<7.82.(Ca)^{0.39}$$

where $$We = \frac{\rho Q U \cos\theta}{\sigma - \alpha F_x} \quad \text{and}$$

$$Ca = \frac{\eta(S + U\sin\theta)}{\sigma - \alpha F_x},$$

recirculation being avoided if the above inequality is satisfied.

Preferably $We<4.82.Ca^{0.39}$

All of the methods suggested in the prior art to avoid the problems associated with heel formation are based on adjustment of a small number of parameters to improve the coating speed/uniformity in the specified situation. Thus a range of optimum hopper slide angle and viscosity to avoid heel formation at a fixed flow rate and curtain height, will work only at the specified height and flow rate. Heel formation can still be a problem if any of the parameters are changed, since the interaction of the parameters is unspecified. The method of the present invention identifies the relationship between all the key coating parameters and allows an a priori optimization of the coating conditions to avoid recirculation. Furthermore it allows a prediction of the likely effect on the recirculation boundary, if one or more of the coating parameters is changed.

The above and other objects, features and advantages of the present invention will become apparent from the following description of a preferred embodiment, in connection with the following drawings, in which;

DETAILED DESCRIPTION OF THE INVENTION

Figure 1:
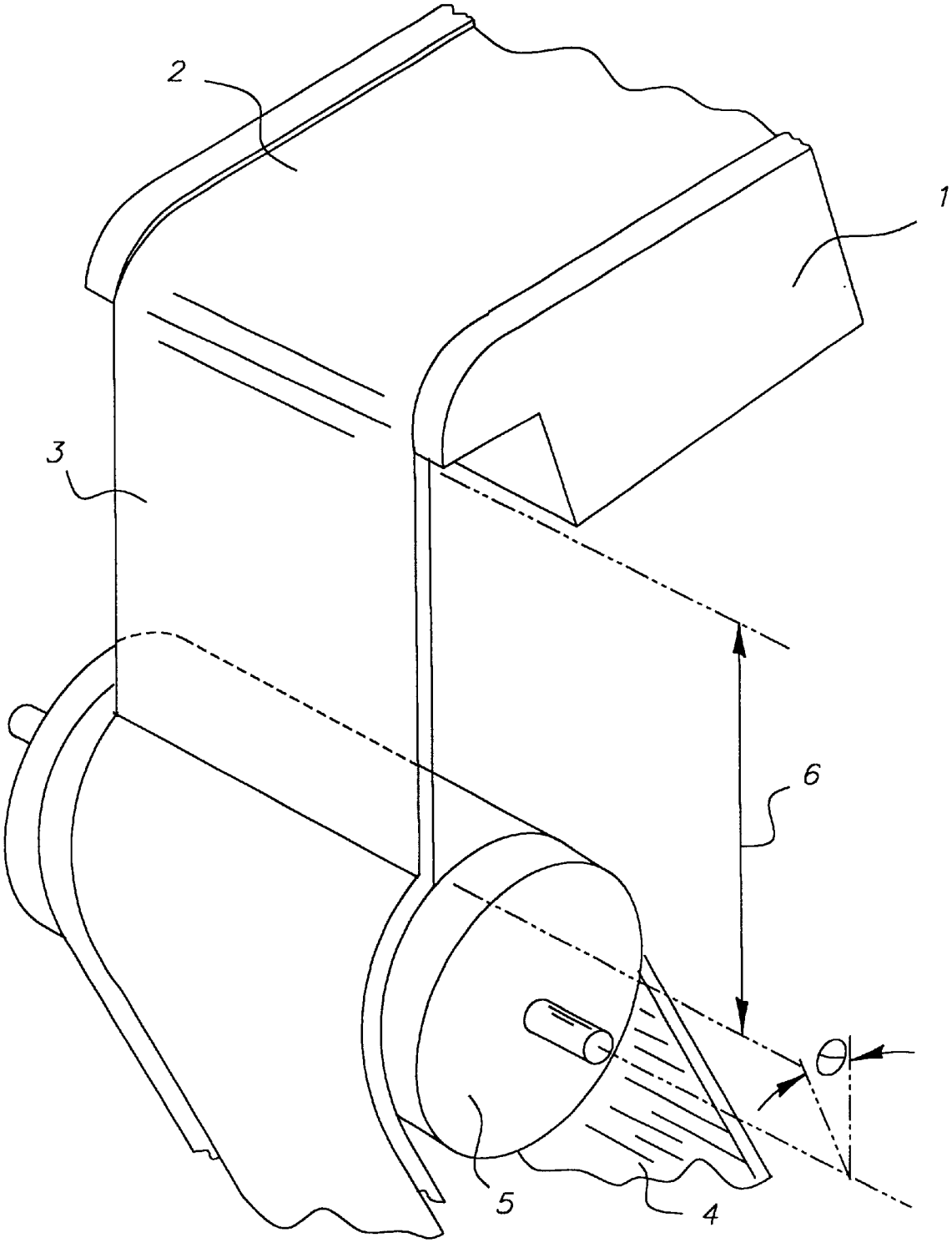
FIG. 1 is a schematic diagram of a typical curtain coating apparatus.

FIG. 1 shows a schematic diagram of a typical curtain coating apparatus.

A slide hopper 1 is located above a coating roller 5. The substrate 4 to be coated is passed around the coating roller 5. The coating is formed from a combination of one or more layers of coating solution emerging from slots in the slide hopper 1. The combined layers 2 are allowed to form a vertical, free falling curtain 3 that impinges on the continuously moving substrate 4 passing around the coating roller 5. The height h (m), of the falling curtain 6 is measured from the hopper lip to the point of impingement on the substrate, and the curtain velocity U (m/s) is given by $U \approx \sqrt{2gh}$. The falling curtain 6 hits the substrate 4 with an application angle $\theta$ (deg.) measured between the horizontal and a tangent to the substrate at the point of impingement.

The liquid curtain, formed of at least one layer of coating solution, has a composite density $\rho$ ($kgm^{-3}$) and has a total volumetric flow rate per unit curtain width Q ($m^2s^{-1}$). The dynamic surface tension of the composition at the rear of the falling curtain is $\sigma$ ($mNm^{-1}$) and the substrate velocity is S ($ms^{-1}$).

The following examples show the effects of the key coating parameters on the tendency to form a recirculating heel. The data points on the graphs mark the speed at which recirculation clears on increasing substrate speed at a given volumetric flow rate per unit width of curtain. The line defined by the data points is termed the recirculation boundary. A coating that has a flow rate and substrate speed situated above the boundary i.e. higher flow rates or slower substrate speeds, will have a recirculating heel. The substrate used for the coatings was gelatin-subbed polyethylene terapthalate in all cases, unless otherwise specified.

Figure 2:
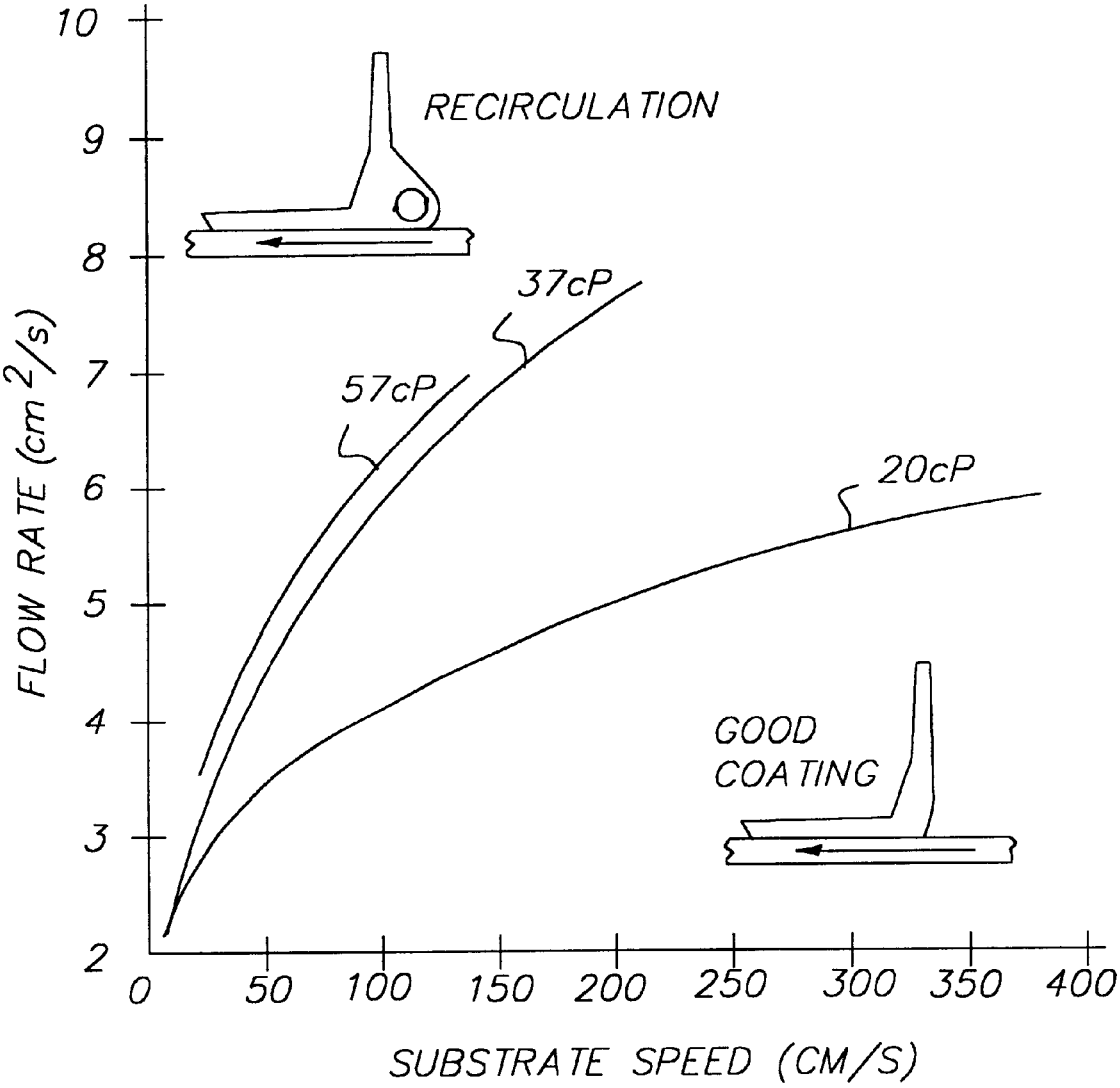
FIG. 2 is a graph showing the effect of solution viscosity on the recirculation boundary of gelatin solutions.

To determine the effect of solution viscosity, data were obtained using gelatin solutions of increasing concentration, 20 cP , 37 cP and 57 cP. These solutions were curtain coated with a 3 cm curtain at an application angle $\theta$=0°. FIG. 2 shows the results obtained. Clearly there is a greater tendency for recirculation as viscosity is reduced, the recirculation boundary being shifted to lower flow rates and higher speeds restricting the parameter space where good coating may be achieved.

Figure 3:
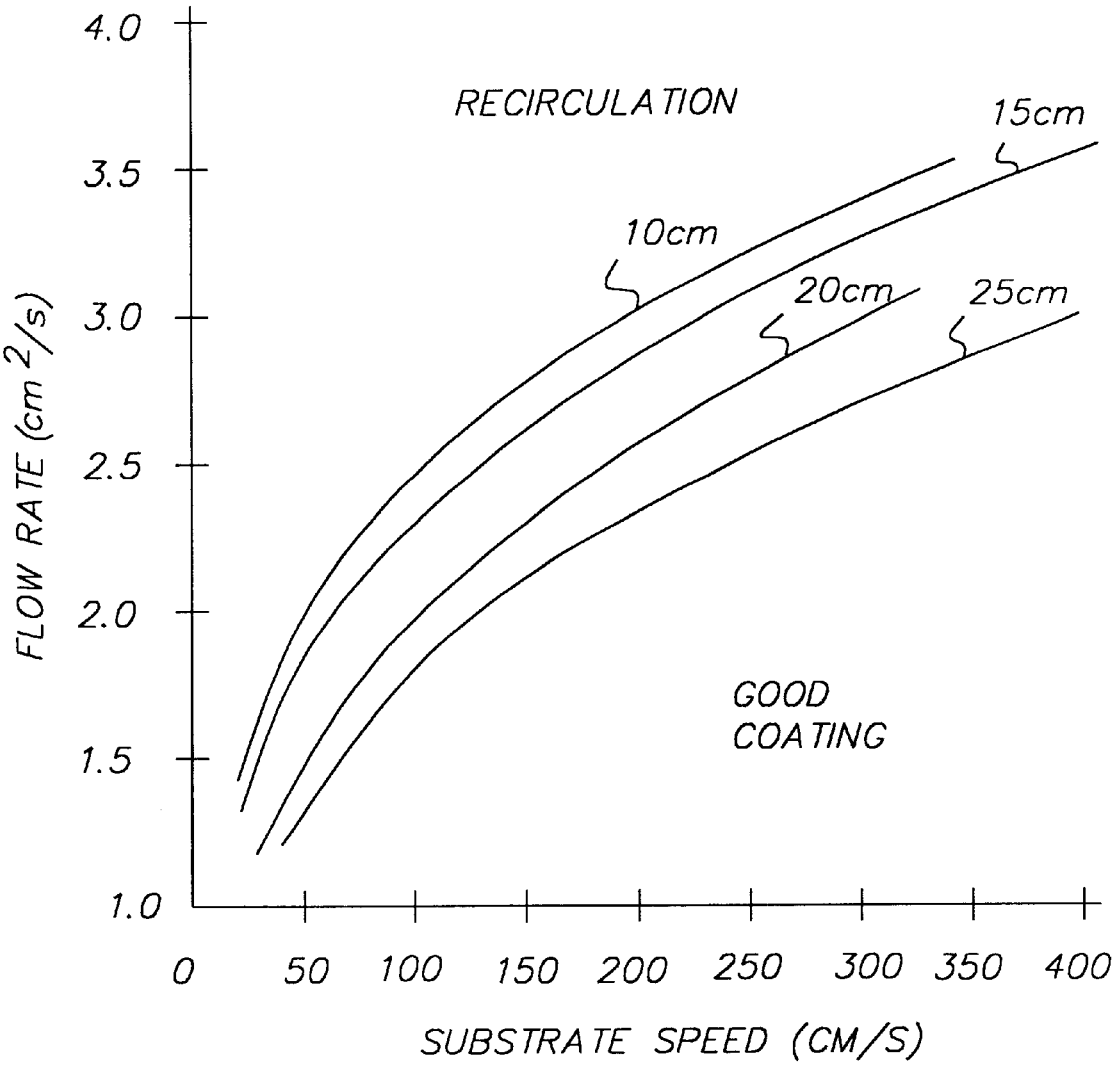
FIG. 3 is a graph showing the effect of curtain height h, on the recirculation boundary of a 15% w/w gelatin solution.

The effect of curtain height was determined using a 15% gelatin solution, curtain coated at an application angle $\theta$=0° with increasing curtain height, from 10 cm to 25 cm. FIG. 3 shows the results obtained. From the data shown in FIG. 3, it is clear that there is a greater tendency for recirculation as the curtain height is increased, with a corresponding reduction in the 'window' of good coating.

Figure 4:
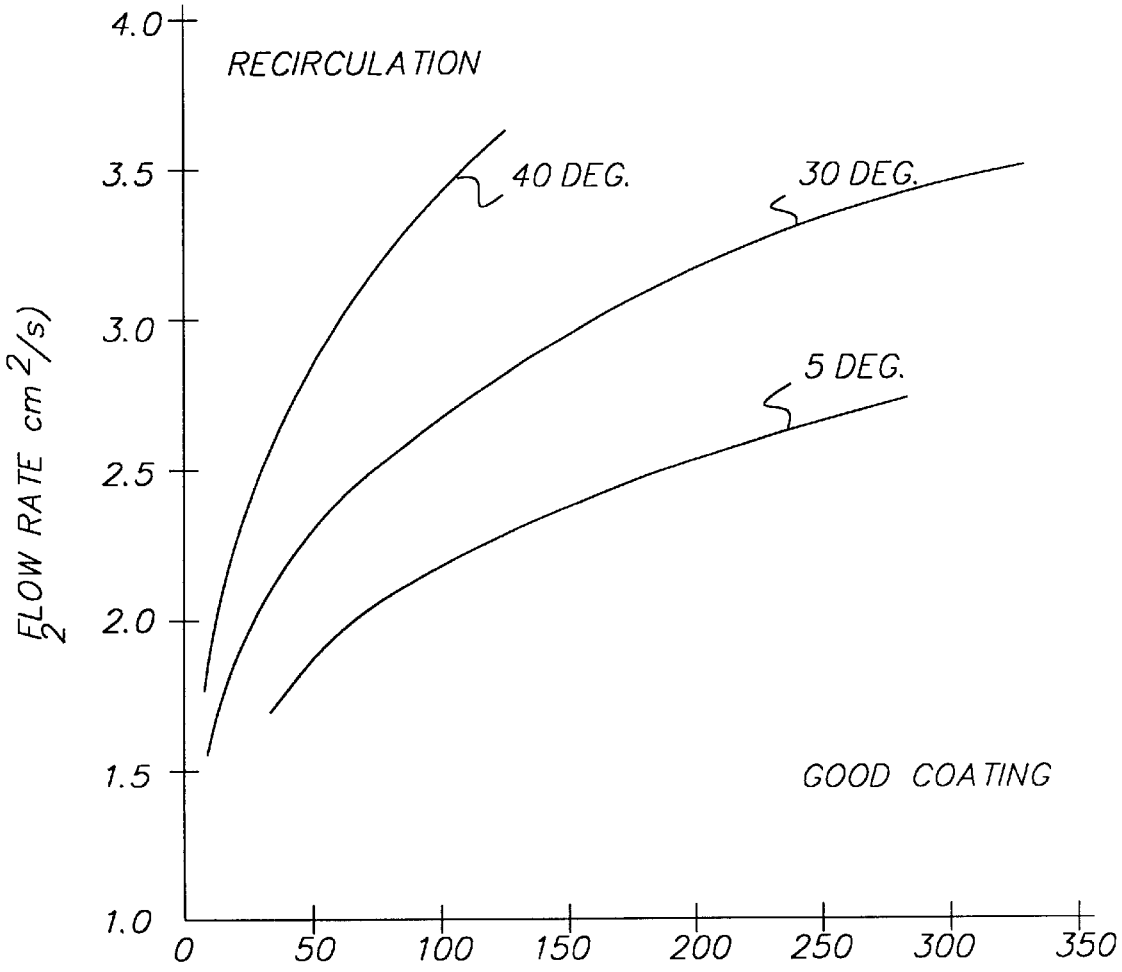
FIG. 4 is a graph showing the effect of application angle $\theta$ on the recirculation boundary of 15% w/w gelatin.

To determine the effect of the application angle, data at application angles of 5°, 30° and 40° were obtained using a 15% gelatin solution curtain coated with a 3 cm curtain. These results are shown in FIG. 4. It is clear from FIG. 4 that increasing the application angle θ reduces the tendency for recirculation. As the application angle θ is increased the component of curtain momentum parallel to the substrate is increased. This pulls the wetting line downstream and tends to inhibit heel formation.

Figure 5:
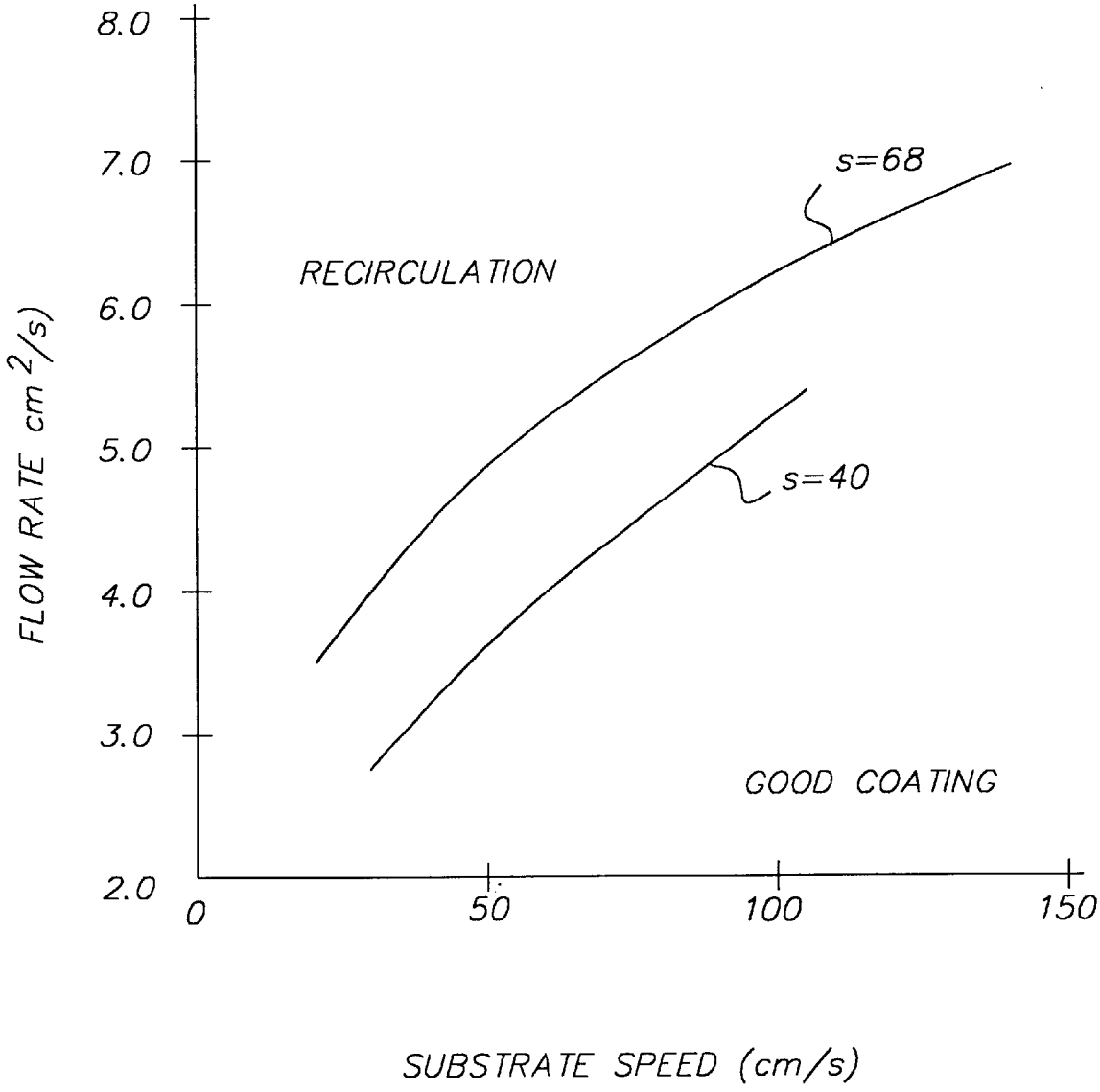
FIG. 5 is a graph showing the effect of dynamic surface tension on the recirculation boundary of 15%w/w gelatin solution.

The effects of dynamic surface tension on the recirculation boundary are illustrated by the addition of 2% anionic polyethylene oxide surfactant (Triton X200E) to a 15% gelatin solution. The surfactant lowers the dynamic surface tension from approximately 68 $mNm^{-1}$ to approximately 40 $mNm^{-1}$. The data shown in FIG. 5 was obtained using a 3 cm curtain at an application angle θ=0°. Decreasing the dynamic surface tension along the free surface of the heel allows for a greater radius of curvature i.e. a larger heel, which clearly increases the tendency for recirculation.

Figure 6:
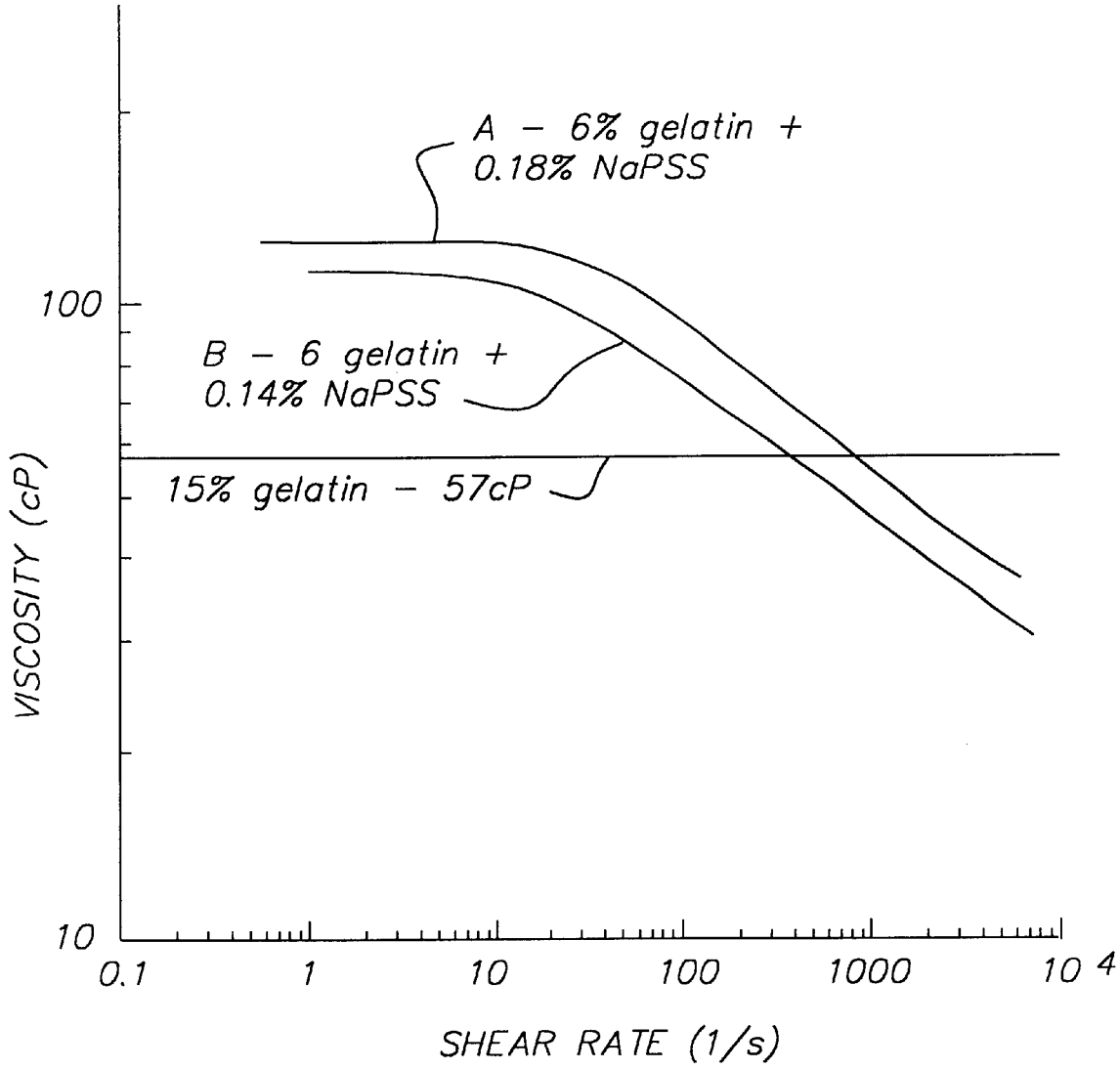
FIG. 6 is graph showing the effect of shear-thinning on recirculation boundary of gelatin+NaPSS solutions.

To determine the effects of rheology, highly shear-thinning solutions of 6% gelatin plus increasing amounts of the polymeric thickener, sodium polystyrene sulphonate (NaPSS) were used. A 15% gelatin solution was also used so that comparison could be made with a solution that showed no shear-thinning over the shear rates of interest. FIG. 6 shows the effects of adding different concentrations of NaPSS on the solution rheology for the 6% gelatin solutions. Solution 'A' was 6% gelatin+0.18% NaPSS, whilst solution 'B' was 6% gelatin+0.14% NaPSS. The critical shear rate for solutions A and B are 28 $s^{-1}$ and 17$s^{-1}$ respectively. In contrast a 15% gelatin solution shows no appreciable shear thinning below shear rates of $10^5 s^{-1}$.

Figure 7:
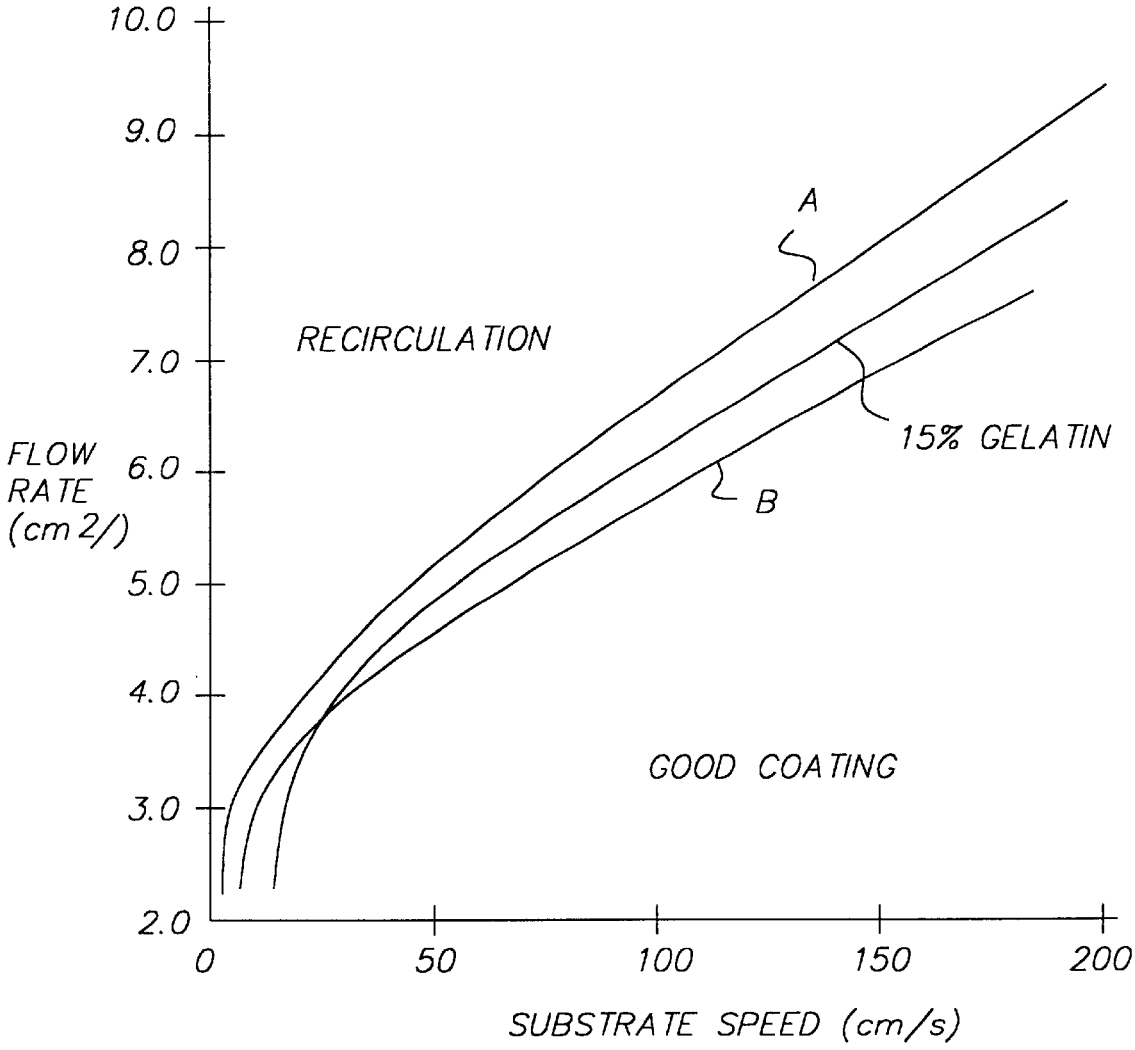
FIG. 7 is a graph used to determine the magnitude of the effective shear rate in the heel region.

FIG. 7 shows the recirculation boundaries for solutions A and B and a 15% gelatin solution. Solution A has a low shear viscosity of 65 cP and solution B has a low shear viscosity of 130 cP, (for shear rates<10$s^{-1}$). The 15% gelatin solution has a viscosity of 57 cP at shear rates up to $10^5 s^{-1}$. Although, from the results shown in FIG. 2, it would be expected that the 15% gelatin solution would have a recirculation boundary below those of solutions A and B it can be seen in FIG. 7 that the recirculation boundary of solution B crosses over the 15% gelatin recirculation boundary at a substrate speed of around 30 $cms^{-1}$. At substrate speeds>30 $cms^{-1}$ solution B has a greater tendency for recirculation than the 15% gelatin solution indicating that shear thinning must have reduced the viscosity of solution B below that of the 15% gelatin solution i.e. <57 cP.

In order for the recirculation boundary of solution B to cross over the recirculation boundary of the 15% gelatin solution, the viscosity of solution B (65 cP<10$s^{-1}$) must have fallen below 57 cP. The point at which the viscosity of solution B falls to 57 cP therefore gives an estimate of the effective shear rate in the heel region, of around 400$s^{-1}$, as seen from FIG. 6.

Figure 8:
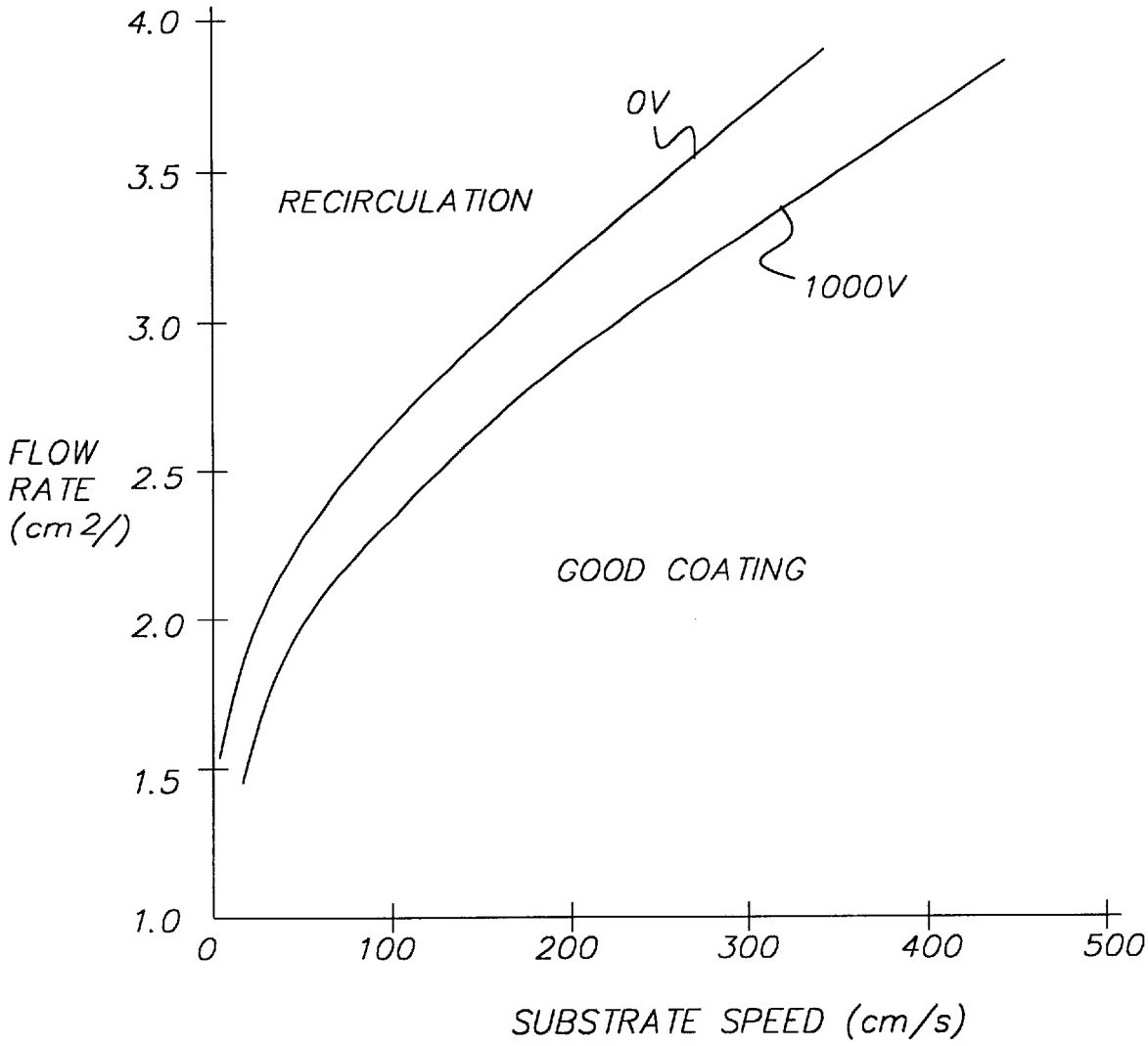
FIG. 8 is a graph showing the effect of an electric field applied at the coating point.

To determine the effects of electrostatic voltage at the coating point, the recirculation boundary data were obtained using a 15% gelatin solution coated with a 3 cm curtain at application angle θ=0°. It can be seen from FIG. 8 that an applied electric field increases the tendency for recirculation shifting the boundary to lower flow rates and higher substrate speeds. The horizontal component of the electric force tends to pull the wetting line backwards, enlarging the heel and so shifting the recirculation boundary to lower flow rates and higher speeds.

Given all the data in the previous figures that show the effects of key coating parameters on the recirculation boundary, it is now possible to collapse the data into a dimensionless form as a master plot.

The total volumetric flow rate Q ($m^2s^{-1}$) and substrate speed S ($ms^{-1}$) are replaced by the dimensionless groups of Weber number (We) and Capillary number (Ca) respectively, as defined in the following equations.

$$We = \frac{\rho Q U \cos\theta}{\sigma - \alpha F_x} \tag{2}$$

$$Ca = \frac{\eta(S + U\sin\theta)}{\sigma - \alpha F_x} \tag{3}$$

where η is the viscosity of the coating solution (or at least the viscosity of the bottom layer), and for shear thinning liquids is measured at a shear rate of 400$s^{-1}$. $F_x$ is the horizontal component of the electric force given by:

$$F_x = \frac{\varepsilon_0}{2\left(\frac{d}{\varepsilon} + \frac{d_1}{\varepsilon_1}\right)} V^2 \tag{4}$$

and $\epsilon_0$=permittivity of vacuum (=8.854×10 $^{-12}Fm^{-1}$)

d=thickness of support (m)

ε=relative permittivity of support $d_1$=thickness of air gap between support and roller (m)

$\epsilon_1$=relative permittivity of air gap

V=electrostatic voltage at coating point (V)

Typically the support thickness d~100 μm and ε=3.2 for the polyethylene terapthalate substrate, whilst the air gap thickness $d_1$~10 μm and $\epsilon_1$=1. The α parameter is a coefficient to scale the electric force appropriately. In the examples described a value of α=0.1 was used.

Figure 9:
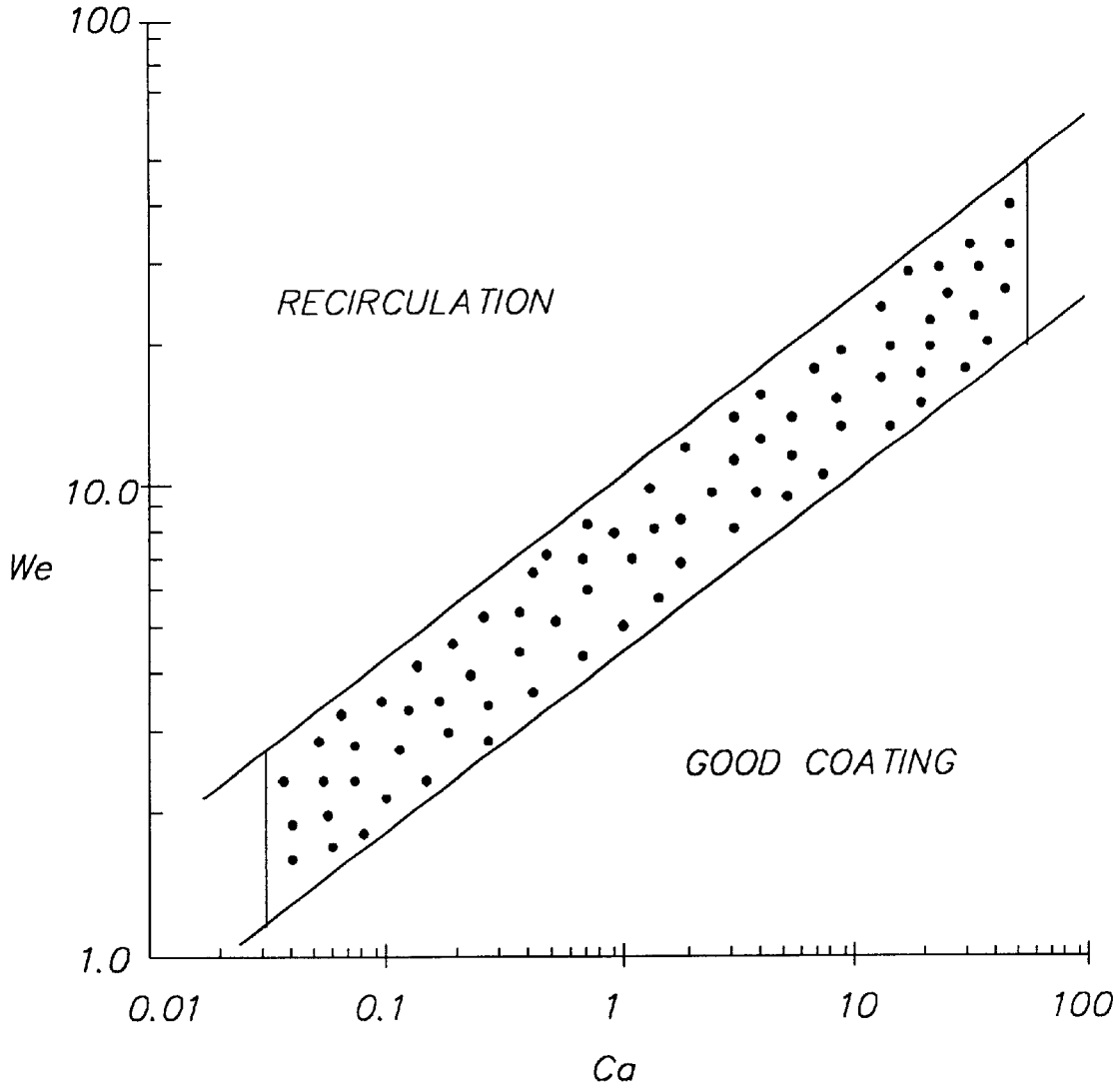
FIG. 9 is a graph showing the data transformed into a dimensionless group.

The shaded area in FIG. 9 is the region defined by:

$$We=(7.8\pm3).Ca^{0.39} \tag{5}$$

Provided the Weber number and Capillary number of the coating fall below the shaded region in FIG. 9 there should be no non-uniformities due to recirculation.

Therefore, given a set of coating parameters, the following inequality can now be used to predict whether or not a recirculating heel will be present:

$$We<7.82.(Ca)^{0.39} \tag{6}$$

EXAMPLES

The following examples illustrate the use of the invention to avoid non uniformities in curtain coated compositions.

Figure 10:
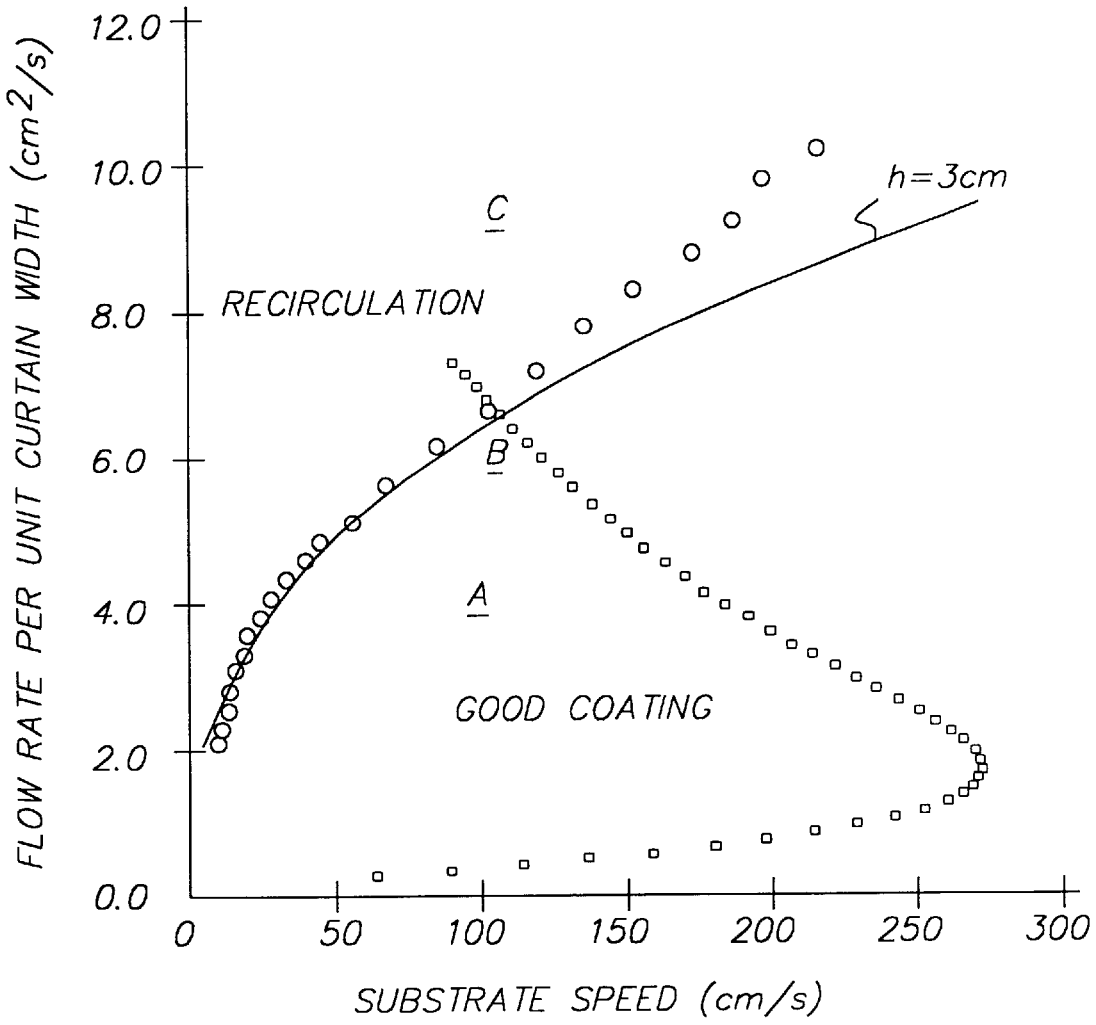
FIG. 10 is a graph used to determine the parameters which can be used to avoid recirculation defects.

1) A coating composition of 6% gelatin+0.18% NaPSS+2% TX200E with a viscosity of 130 cP at a shear rate of 500$s^{-1}$ was curtain coated onto gelatin-subbed PET substrate with a 3 cm curtain at 0° application angle. The open circles in FIG. 10 mark the speed at which recirculation cleared on increasing web speed. At combinations of flow rate and substrate speed lying below the circles, a uniform coating was obtained. However at combinations of flow and speed lying above the circles, the coating showed lines and streaks due to bubble trapping within the heel, or broad lines due to non-laminar flow of liquid through the recirculating heel. The solid line through the points in FIG. 10 is the recirculation boundary predicted using equation (6). The open squares on the graph mark the air entrainment boundary. Increasing substrate speed beyond the points marked results in air being entrained between the coating solution and substrate. Table 1. lists the Weber number defined by equation (2) for each of the points marked A, B and C on the graph, and the value predicted by equation (6)

TABLE 1

| Point on map | A | B | C |
|---|---|---|---|
| We from eqn. (2) | 5.8 | 11.5 | 19.2 |
| We from eqn. (6) | 12.4 | 12.4 | 12.4 |
| Substrate Speed. (cm/s) | 100 | 100 | 100 |
| Flow ($cm^2/s$) | 3 | 6 | 10 |
| Uniform coating | Yes | Yes | No |

A coating manufactured with parameters specified by point A (We<12.4) on the plot avoids any non-uniformities due to recirculation. However a coating manufactured with the parameters specified by point C (We>12.4) is susceptible to non-uniformities due to the presence of a recirculating heel. Point B is just beneath the recirculation boundary (We=11.5). At this point, although there is no recirculation, a significant heel is still present. Point B is also where the air entrainment boundary and recirculation boundary cross. Further increases in substrate speed lead to air entrainment with recirculation, otherwise termed sagging. When both the air entrainment boundary and the recirculation boundary are known, it is then possible to predict when sagging will occur. At speeds beyond point B, the prediction of the recirculation is less accurate due to air entrainment.

Figure 11:
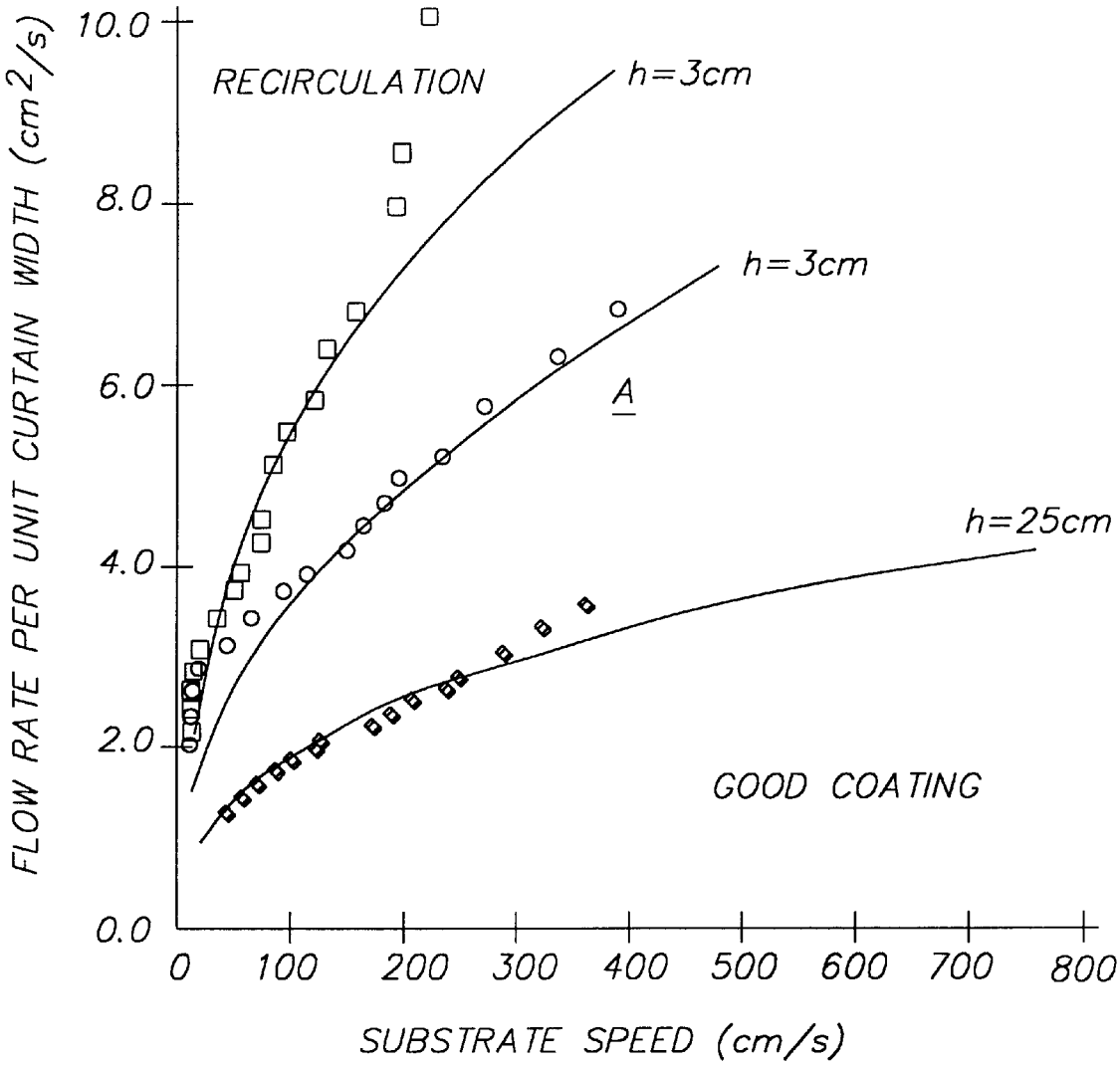
FIG. 11 is another example of a graph illustrating use of the invention to determine the parameters which can be used to avoid recirculation defects.

2) A 10% gelatin solution with a viscosity of 20 cP at a shear rate of $500s^{-1}$ was curtain coated onto a gelatin-subbed PET substrate with a 3 cm curtain at 0° application angle. In addition a 13% gelatin solution with a viscosity of 37 cP at a shear rate of $500s^{-1}$ was curtain coated onto PET substrate with a 3 cm curtain and a 25 cm curtain at 0° application angle. The open circles in FIG. 11 mark the speed at which recirculation cleared on increasing substrate speed for the 20 cP gelatin solution. The open squares in FIG. 11 mark the speed at which recirculation cleared on increasing substrate speed for the 37 cP gelatin solution. Solid lines are predicted recirculation boundaries using equation (6). The prior art disclosed in JP 1131549 and U.S. Pat. No. 5,393,571 suggests that above a flow rate of 4 $cm^2s^{-1}$ with solution viscosity<40 cP it would not be possible to avoid recirculation or heel formation at practical coating speeds. However the data in FIG. 11 shows that by adjusting the curtain height, recirculation and heel formation can be controlled to allow uniform coating of the 20 cp or 37 cP gelatin solutions at a coating speed of 250 m/min with a flow rate of 6 $cm^2s^{-1}$, point A in the plot. The open diamonds in FIG. 11 mark the speed at which recirculation cleared on increasing substrate speed for the 37 cP gelatin solution with a 25 cm curtain, the solid line through the points is a fit from equation (6). Table 2 lists the Weber number for point A and the Weber numbers predicted from equation (6) for the coating conditions shown in FIG. 11.

TABLE 2

| Soln. Visc (cP), h (cm) | We point A | We eqn. (6) | Uniform Coating |
|---|---|---|---|
| 20, 3 | 8.9 | 9.5 | Yes |
| 37, 3 | 6.9 | 12.1 | Yes |
| 37, 10 | 12.5 | 12.1 | No |
| 37, 25 | 19.8 | 12.1 | No |

The invention provides a more accurate prediction of the limits of the "coating window", i.e. the limits within which operational variables must be held in order to obtain a uniform coating.

The present invention has been described in detail with reference to preferred embodiments. It will be understood by those skilled in the art that variations and modifications can be made within the scope of the invention.

What is claimed is:

1. A method of curtain coating which avoids coating defects due to recirculation, the curtain, being formed from at least one layer of coating solution, having a composite density ρ ($kgm^{-3}$) and a total volumetric flow rate per unit curtain width Q ($m^2s^{-1}$), the curtain being allowed to free fall a distance h (m), at a velocity U ($ms^{-1}$), onto a continuously moving substrate having a velocity S ($ms^{-1}$) with an application angle of θ between the horizontal and tangent to the substrate at the point of impingement, the dynamic surface tension at the rear of the falling curtain being σ ($mNm^{-1}$), the aforementioned variable parameters being controlled so as to satisfy the following inequality;

$$We<7.82.(Ca)^{0.39}$$

where $$We = \frac{\rho Q U \cos\theta}{\sigma - \alpha F_x} \quad \text{and}$$

$$Ca = \frac{\eta(S + U\sin\theta)}{\sigma - \alpha F_x},$$

η= the viscosity of the coating solution and $F_x$ is the horizontal component of an electric force applied at the coating point, recirculation being avoided if the above inequality is satisfied.

2. A method as claimed in claim 1 wherein $We<4.82.Ca^{0.39}$.

3. A method according to claim 1 wherein the viscosity of the coating composition adjacent to the receiving substrate has a viscosity>30 cP at a shear rate of $400s^{-1}$.

4. A method according to claim 1 wherein the height h of the curtain is between 3 cm and 30 cm.

5. A method as according to claim 1 wherein the application angle θ is between 0° and 60°.

* * * * *